US007664444B2

(12) United States Patent
Mochizuki

(10) Patent No.: US 7,664,444 B2
(45) Date of Patent: Feb. 16, 2010

(54) IMAGE FORMING APPARATUS WITH MULTIPLE IMAGE FORMING MODES

(75) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 11/866,079

(22) Filed: Oct. 2, 2007

(65) Prior Publication Data

US 2008/0095556 A1 Apr. 24, 2008

(30) Foreign Application Priority Data

Oct. 24, 2006 (JP) ..... 2006-289269

(51) Int. Cl.
*G03G 15/01* (2006.01)

(52) U.S. Cl. ..... 399/302; 399/66; 399/299

(58) Field of Classification Search ..... 399/66, 399/298–299, 302; 347/115
See application file for complete search history.

(56) References Cited

U.S. PATENT DOCUMENTS

| | | | | |
|---|---|---|---|---|
| 6,298,212 | B1 | 10/2001 | Kono et al. | |
| 6,768,891 | B2 * | 7/2004 | Sasamoto et al. | 399/228 |
| 6,904,245 | B2 | 6/2005 | Mochizuki et al. | |
| 6,934,497 | B2 | 8/2005 | Hagiwara et al. | |
| 6,957,033 | B2 | 10/2005 | Saito et al. | |
| 6,990,300 | B2 | 1/2006 | Saito et al. | |
| 7,130,550 | B2 | 10/2006 | Mochizuki | |
| 7,130,568 | B2 | 10/2006 | Mochizuki | |
| 2007/0071486 | A1 * | 3/2007 | Chiba et al. | 399/101 |

FOREIGN PATENT DOCUMENTS

| | | | |
|---|---|---|---|
| JP | 2000-298408 | A | 10/2000 |
| JP | 2001-083758 | A | 3/2001 |
| JP | 2001-249519 | A | 9/2001 |
| JP | 2003-337454 | A | 11/2003 |
| JP | 2004-117426 | A | 4/2004 |
| JP | 2004-118114 | A | 4/2004 |
| JP | 2004-317915 | A | 11/2004 |
| JP | 2005-062642 | A | 3/2005 |
| JP | 2006-119508 | A | 5/2006 |

* cited by examiner

*Primary Examiner*—David M Gray
*Assistant Examiner*—Barnabas T Fekete
(74) *Attorney, Agent, or Firm*—Fitzpatrick, Cella, Harper & Scinto

(57) ABSTRACT

An image forming apparatus comprising first and second image bearing members, an intermediate transfer belt, a secondary transfer unit, a belt contacting and separating unit, a supporting member, and a separating unit, wherein, when the toner images are primarily transferred from the first and second image bearing members onto the intermediate transfer belt in a state where the intermediate transfer belt is in contact with the first and second image bearing members, the separating unit separates the supporting member from the intermediate transfer belt, and when the toner image is primarily transferred from the second image bearing member onto the intermediate transfer belt in a state where the intermediate transfer belt is away from the first image bearing member, the supporting member supports an inner surface of the intermediate transfer belt between the first and second image bearing members.

8 Claims, 9 Drawing Sheets

IMAGE FORMING APPARATUS WITH MULTIPLE IMAGE FORMING MODES

BACKGROUND OF THE INVENTION

1. Field of the Invention

The present invention relates to an image forming apparatus for transferring a toner image onto a recording material by using a belt member for directly or indirectly conveying the toner image. More particularly, the invention relates to such a technique that a disturbance of a toner image which is conveyed is prevented by controlling a supporting member for supporting a belt member.

2. Description of the Related Art

An image forming apparatus in which toner images of separating colors formed on photosensitive drums are overlaid and transferred onto an intermediate transfer belt and a full-color image is formed has been put into practical use. An image forming apparatus in which toner images of different separating colors are overlaid and transferred onto a recording material which has been adsorbed onto a recording material conveying belt and conveyed thereby and a full-color image is formed has also been put into practical use. A full-color image forming apparatus in which a photosensitive drum to form a toner image of black is arranged on the most downstream side, and in the case of forming a monochrome image, only the photosensitive drum to form the black toner image is used has also been put into practical use.

Image forming apparatuses in each of which a belt member is separated from image bearing members for forming toner images of separating colors other than black and a monochrome image is formed by a photosensitive drum on the most downstream side have been disclosed in Japanese Patent Application Laid-Open Nos. 2001-249519, 2004-117426, and 2005-62642. The belt member is separated and the photosensitive drums and a charging apparatus which are not concerned with the image forming are stopped, thereby preventing an unnecessary mechanical abrasion and saving electric power consumption.

A supporting roller for supporting an inside surface of the belt member and keeping a contacting position of the belt member on the photosensitive drum on the most downstream side constant is arranged between the two photosensitive drums located on the most downstream side. When the monochrome image is formed, the belt member is bent and supported by the supporting roller on the downstream side separated from a plurality of photosensitive drums.

In the image forming apparatuses disclosed in the above-identified patent documents, it has been found that when the color image is formed by circulating the intermediate transfer belt, a disturbance occurs in the toner image on the intermediate transfer belt. As will be described hereinafter, it has been confirmed that in the case of circulating the intermediate transfer belt, when the belt passes through the supporting roller, an uneven charge occurs in the intermediate transfer belt and the toner image on the intermediate transfer belt is scattered. Specifically, a toner scattering phenomenon of a thin line image or a lateral striped flutter in a halftone image occurs.

SUMMARY OF THE INVENTION

The invention intends to reduce a disturbance of a toner image which is caused by contact between a supporting roller and an intermediate transfer belt.

According to the invention, there is provided an image forming apparatus comprising first and second image bearing members which bear toner images, an intermediate transfer belt onto which the toner images are primarily transferred from the first and second image bearing members, a secondary transfer unit which secondarily transfers the toner image on the intermediate transfer belt onto a recording material, a belt contacting and separating unit which allows the intermediate transfer belt to separate from and to come into contact with the first image bearing member, an image forming mode executing unit which executes a first image forming mode in which the toner images are primarily transferred from the first and second image bearing members onto the intermediate transfer belt, in a state where the intermediate transfer belt is in contact with the first and second image bearing members and a second image forming mode in which the toner image is primarily transferred from the second image bearing member onto the intermediate transfer belt, in a state where the intermediate transfer belt is separated from the first image bearing member, a supporting member which supports an inner surface of the intermediate transfer belt between the first and second image bearing members when the second image forming mode is executed; and a separating unit which separates the supporting member from the intermediate transfer belt when the first image forming mode is executed.

There is also provided an image forming apparatus comprising first and second image bearing members which bear toner images, a recording material bearing belt which bears a recording material, a transfer unit which transfers the toner images from the first and second image bearing members onto the recording material borne to the recording material bearing belt, a belt contacting and separating unit which allows the recording material bearing belt to separate from and to come into contact with the first image bearing member, an image forming mode executing unit which executes a first image forming mode in which the toner images are transferred from the first and second image bearing members onto the recording material borne to the recording material bearing belt, in a state where the recording material bearing belt is in contact with the first and second image bearing members and a second image forming mode in which the toner image is transferred from the second image bearing member onto the recording material bearing belt, in a state where the recording material bearing belt is separated from the first image bearing member, a supporting member which supports an inner surface of the recording material bearing belt between the first and second image bearing members when the second image forming mode is executed, and a separating unit which separates the supporting member from the recording material bearing belt when the first image forming mode is executed.

Further features of the present invention will become apparent from the following description of exemplary embodiments with reference to the attached drawings.

DESCRIPTION OF THE EMBODIMENTS

A full-color image forming apparatus according to an embodiment of the invention will now be described in detail with reference to the drawings. The image forming apparatus of the invention is not limited to a restrictive construction of the embodiment, which will be described hereinbelow. The invention can be also realized by another embodiment in which a part or all of the construction of each embodiment has been replaced with an alternative construction so long as a supporting roller is separated from an intermediate transfer belt on a downstream side of a photosensitive drum, thereby avoiding an electric influence on the intermediate transfer belt and the like.

In the embodiment, a tandem-type image forming apparatus in which four photosensitive drums 1*a*, 1*b*, 1*c*, and 1*d* are arranged along an intermediate transfer belt 51 will be described. The image forming apparatus of the invention may be replaced by an image forming apparatus in which four or more photosensitive drums including neutral colors are arranged along a recording material conveying belt or an image forming apparatus having a monochrome specification using one photosensitive drum. In the embodiment, in the apparatus which forms images of four colors of yellow, magenta, cyan, and black, the operation in a black monochromatic mode will be described in detail. The above-described construction can be also applied to one of an image forming apparatus using colors other than the above-mentioned four colors and an image forming apparatus using toner of light colors.

The image forming apparatus of the invention can be embodied corresponding to various applications such as a printer, various printing apparatuses, a copying apparatus, a facsimile apparatus (FAX), a multifunction printer (MFP), and the like.

With respect to constructions of the image forming apparatuses disclosed in Japanese Patent Application Laid-Open Nos. 2001-249519, 2004-117426, and 2005-62642, power sources mounted in those apparatuses, detailed structures of the apparatuses and devices, control, and the like, their drawings are omitted and their detailed description is also omitted in order to avoid repetitiveness.

<Image Forming Apparatus>

Figure 1:
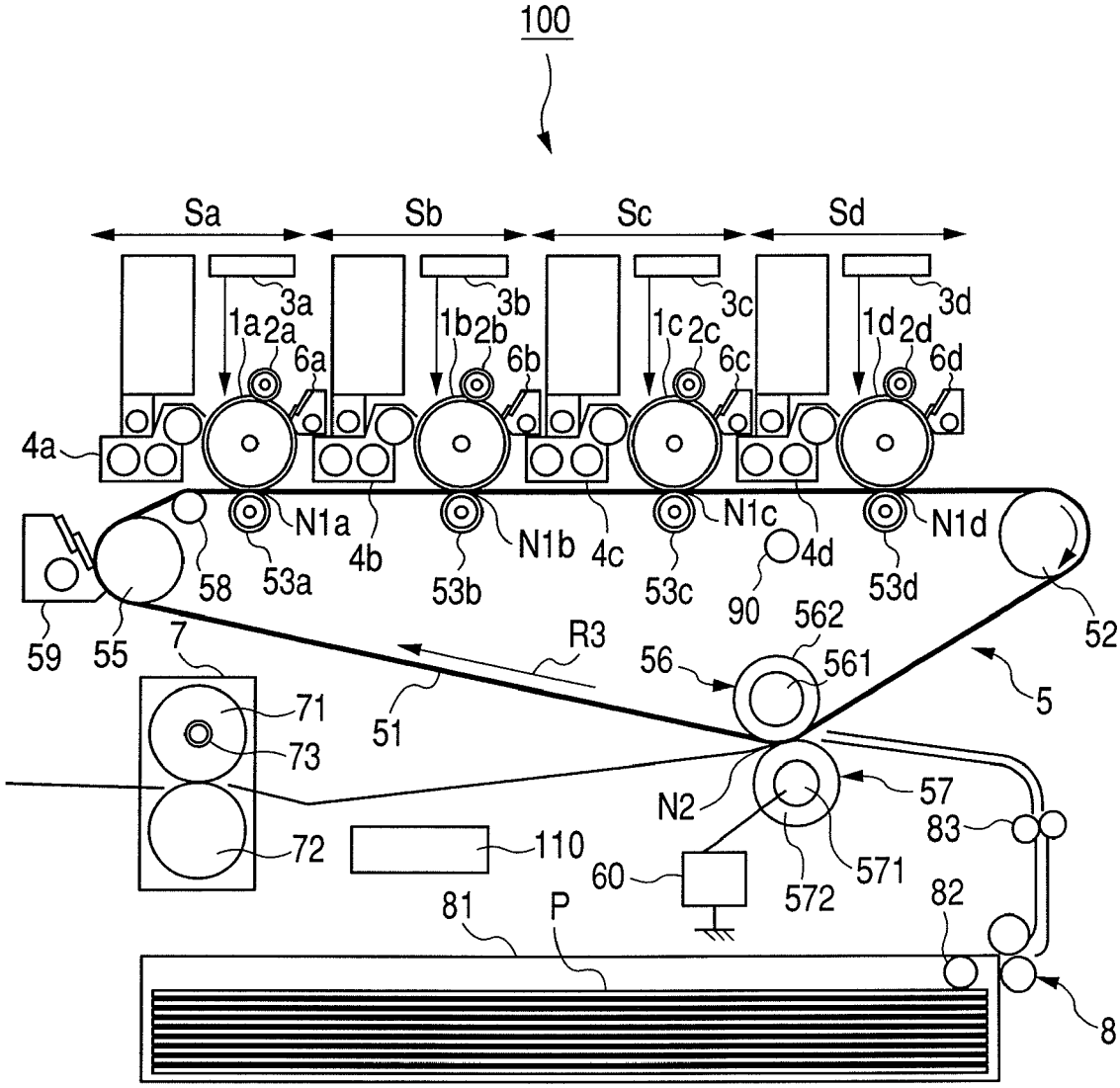
FIG. 1 is an explanatory diagram illustrating a construction of a tandem-type, full-color image forming apparatus.
Figure 2:
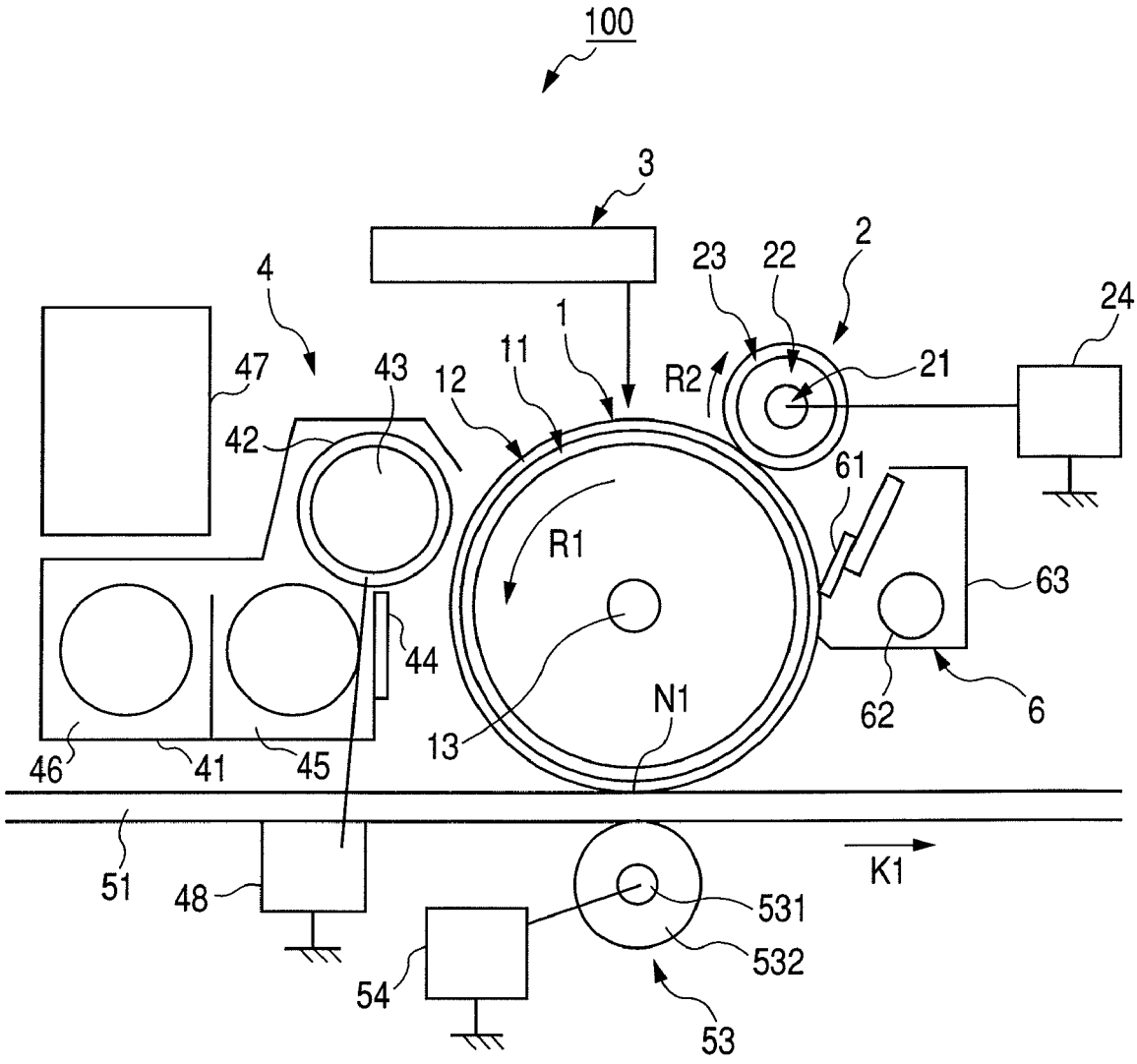
FIG. 2 is an explanatory diagram illustrating a construction of an image forming portion of each separating color.

FIG. 1 is an explanatory diagram illustrating the construction of the tandem-type, full-color image forming apparatus. FIG. 2 is an explanatory diagram illustrating a construction of an image forming portion of each separating color. As illustrated in FIG. 1, an image forming apparatus 100 is the tandem-type, full-color image forming apparatus of an intermediate transfer system in which image forming portions Sa, Sb, Sc, and Sd constructed as units are arranged along the intermediate transfer belt 51. The image forming portions Sa, Sb, Sc, and Sd have photosensitive drums 1*a*, 1*b*, 1*c*, and 1*d* and form toner images of separating colors of yellow, magenta, cyan, and black by electrophotographic processes, respectively.

The image forming portions Sa, Sb, Sc, and Sd are constructed in common except that colors of developer (toner) filled in developing apparatuses 4*a*, 4*b*, 4*c*, and 4*d* are different. Detailed structures of the image forming portions Sa, Sb, Sc, and Sd will be described in common with reference to FIG. 2 which collectively illustrates those image forming portions in which suffixes (a, b, c, d) are omitted from reference numerals indicating respective component elements of the image forming apparatuses.

As illustrated in FIG. 2, the image forming portion S (Sa, Sb, Sc, Sd: FIG. 1) has a photosensitive drum 1 (1*a*, 1*b*, 1*c*, 1*d*: FIG. 1) as an image bearing member. A primary charging roller 2, an exposing apparatus 3, a developing apparatus 4, a primary transfer roller 53, and a cleaning apparatus 6 are sequentially arranged in the direction shown by an arrow R1 around the photosensitive drum 1 which rotates in the direction of the arrow R1.

The photosensitive drum 1 is a cylindrical electrophotographic photosensitive member obtained by forming a photoconductive layer 12 on an outer periphery of a conductive base material 11 made of aluminum or the like. A charging polarity of the surface of the drum 1 is set to a negative polarity. The photosensitive drum 1 is rotatably supported by a supporting axis 13 at the center and rotated by a driving source (not shown).

The primary charging roller (primary transfer unit) 2 comes into pressure contact with the photosensitive drum 1 in a state where a charging bias voltage has been applied by a charging bias power source 24 and is driven and rotated in the direction shown by an arrow R2, thereby charging the surface of the photosensitive drum 1 to a predetermined electric potential of negative polarity. The primary charging roller 2 is constructed in such a manner that a rotary axis is formed by arranging a conductive core 21 at a center of a low-resistance conductive layer 22 made of a conductive foaming material, an outer periphery of the core 21 is coated with a middle-resistance conductive layer 23, and the whole structure is formed in a roller shape. Since both edge portions of the core 21 are rotatably supported by bearing members (not shown) and the core 21 is urged toward the photosensitive drum 1 by a pressing spring (not shown), the primary charging roller 2 comes into pressure contact with the surface of the photosensitive drum 1 by a predetermined pressing force.

In the exposing apparatus 3, a laser beam pulse-modulated by an image signal which has been obtained by developing image data along a scanning line is scanned by a polygon mirror (not shown) and the surface of the photosensitive drum 1 is scanned and exposed. An electric potential according to pixel concentration is written along the scanning line of the exposure onto the surface of the photosensitive drum 1 which has uniformly been charged, so that an electrostatic latent image is formed onto the surface of the photosensitive drum 1.

The developing apparatus 4 deposits the developer onto the electrostatic latent image on the surface of the photosensitive drum 1, thereby developing it to a toner image. A two-component developer in which non-magnetic toner particles (toner) and magnetic carrier particles (carrier) have been mixed is enclosed in a developer container 41. The developer container 41 is partitioned into a developing room 45 and an agitating room 46. A supplementing chamber 47 in which toner for supplementation has been enclosed is connected over the agitating chamber 46.

A developing sleeve 42 is rotatably attached to an opening portion of the developer container 41 which faces the photosensitive drum 1. A magnet roller 43 is non-rotationally and fixedly arranged in the inside of the developing sleeve 42. In association with the rotation of the developing sleeve 42, the two-component developer held to the developing sleeve 42 by a magnetic field of the magnet roller 43 is regulated so as to form a thin layer by a regulating blade 44 and supplied to a developing area which faces the surface of the photosensitive drum 1. In the developing area, the two-component developer comes into contact with magnetic brush by the magnetic field of the magnet roller 43. The surface of the photosensitive drum 1 is abraded by the magnetic brush. Since the developing bias voltage has been applied to the developing sleeve 42 by a developing bias power source 48, the toner deposited to the carrier constructing the ears of the magnetic brush is electrostatically moved and deposited to the electrostatic latent image on the photosensitive drum 1. In this instance, the toner image is formed by an inverting phenomenon in which the toner which has been charged to the same polarity (negative polarity) as the charging polarity of the photosensitive drum 1 is deposited onto the portion whose electric potential of the negative polarity has been attenuated by the exposure of the surface of the photosensitive drum 1.

The toner image formed on the surface of the photosensitive drum 1 is primarily transferred onto the charged intermediate transfer belt 51 by using the primary transfer roller 53. The primary transfer roller 53 is formed in such a manner that an outer peripheral surface of a core 531 also serving as a rotary axis is covered with a cylindrical conductive layer 532. Both edge portions of the core 531 which have rotatably been supported are urged by spring members (not shown), so that the conductive layer 532 comes into pressure contact with the photosensitive drum 1 by a predetermined pressing force through the intermediate transfer belt 51. The primary transfer roller 53 is in pressure contact with the inside surface of the intermediate transfer belt 51 and is driven and rotated in association with the movement of the intermediate transfer belt 51.

By connecting a primary transfer bias power source 54 to the core 531 and applying the primary transfer bias voltage thereto, the primary transfer roller 53 forms a primary transfer portion N1 between the intermediate transfer belt 51 and the photosensitive drum 1. At the time of the primary transfer of the toner image, a primary transfer bias voltage of a polarity (positive polarity) opposite to the normal charging polarity (negative polarity) of the toner is applied to the primary transfer roller 53. An electric field for urging the toner particles charged to the negative polarity on the surface of the photosensitive drum 1 toward the intermediate transfer belt 51 is formed between the primary transfer roller 53 and the photosensitive drum 1. The toner particles responsive to the electric field are moved from the photosensitive drum 1 to the intermediate transfer belt 51.

The residual transfer toner and the like which are not primarily transferred in the primary transfer portion N1 are removed by the cleaning apparatus 6, thereby making the surface of the photosensitive drum 1 ready for the next processes from the primary charging to the primary transfer. In the cleaning apparatus 6, a cleaning blade 61 made of a soft elastic material is allowed to slide and rub the surface of the photosensitive drum 1, thereby scraping off the deposited substance on the surface of the photosensitive drum 1 into a drum cleaner housing 63. The waste toner deposited in the drum cleaner housing 63 is conveyed in the axial direction by a conveying screw 62 and stored into a waste toner container (not shown).

As illustrated in FIG. 1, the intermediate transfer belt 51 is arranged so as to be in pressure contact with the image forming portions Sa, Sb, Sc, and Sd in common. The toner images of the four separating colors formed by the photosensitive drums 1*a*, 1*b*, 1*c*, and 1*d* are overlaid and primarily transferred onto the intermediate transfer belt 51, conveyed to a secondary transfer portion N2, and secondarily transferred onto a recording material P in a lump by the secondary transfer portion N2.

The intermediate transfer belt 51 is collected to an intermediate transfer unit 5 in a state where the belt 51 has been suspended among a driving roller 52, a driven roller 55, a secondary transfer inner roller 56, and an upstream regulating roller 58. The intermediate transfer belt 51 is driven by the driving roller 52 connected to a driving source (not shown) and circulated in the direction shown by an arrow R3, thereby allowing the photosensitive drums 1*a*, 1*b*, 1*c*, and 1*d* which are in pressure contact to be driven-rotated. Since the inside surface of the intermediate transfer belt 51 is pressed by primary transfer rollers 53*a*, 53*b*, 53*c*, and 53*d*, its outer surface comes into pressure contact with the photosensitive drums 1*a*, 1*b*, 1*c*, and 1*d*, thereby forming primary transfer portions N1*a*, N1*b*, N1*c*, and N1*d*.

A secondary transfer outer roller (secondary transfer unit) 57 which faces the secondary transfer inner roller 56 through the intermediate transfer belt 51 comes into pressure contact with the intermediate transfer belt 51 and forms the secondary transfer portion N2. A recording material supplying unit 8 supplies the recording material P to the secondary transfer portion N2 at the timing synchronized with the toner image on the intermediate transfer belt 51. That is, the recording materials P are extracted one-by-one by a pickup roller 82 from a cassette 81 in which the recording materials P have been enclosed. The extracted recording material P is set into a standby mode at a registration roller 83. The registration roller 83 is made operative at a timing matched with a head of the toner image on the intermediate transfer belt 51, thereby transferring the recording material P to the secondary transfer portion N2. The recording material P passes through the secondary transfer portion N2 at a speed equal to a circulating speed of the intermediate transfer belt 51 and the toner image on the intermediate transfer belt 51 is secondarily transferred onto the recording material P.

A secondary transfer bias power source 60 is connected to the secondary transfer outer roller 57. A secondary transfer bias voltage of a polarity (positive polarity) opposite to the normal charging polarity (negative polarity) of the toner is applied to the secondary transfer roller 57 at the time of the secondary transfer of the toner image. An electric field for urging the toner particles charged to the negative polarity on the intermediate transfer belt 51 toward the recording material P is formed between the secondary transfer inner roller 56 connected to the ground potential and the secondary transfer outer roller 57 to which the secondary transfer bias voltage has been applied. Since the toner particles responsive to the electric field are moved from the intermediate transfer belt 51 to the recording material P, the toner images of the separating colors of yellow, magenta, cyan, and black are secondarily transferred in a lump onto the recording material P.

The recording material P which has passed through the secondary transfer portion N2 and on which the full-color toner image has been secondarily transferred is conveyed to a fixing apparatus 7. The fixing apparatus 7 has a rotatable fixing roller 71 and a pressing roller 72 which rotates in pressure contact with the fixing roller 71. A halogen lamp heater 73 is arranged in the fixing roller 71. A temperature of the surface of the fixing roller 71 is adjusted by controlling an electric power which is supplied to the heater 73. When the recording material P conveyed to the fixing apparatus 7 passes through a pressing nip between the fixing roller 71 which rotates at a predetermined speed and the pressing roller 72, the recording material is pressed and heated from both of the front and back sides by predetermined pressure and temperature. The non-fixed toner image on the surface of the recording material P is fused and fixed onto the recording material P, so that a full-color image is formed.

The residual transfer toner which is not secondarily transferred onto the recording material P in the secondary transfer portion N2 but remains on the intermediate transfer belt 51 is conveyed to a belt cleaning apparatus 59 in association with the circulation of the intermediate transfer belt 51 and removed and collected. In a manner similar to the cleaning apparatus 6, the belt cleaning apparatus 59 scrapes off the residual transfer toner into the drum cleaner housing by using the cleaning blade, is conveyed by the conveying screw, and stored into the waste toner container.

A processing speed in the embodiment, that is, a peripheral speed of each of the photosensitive drum 1 and the intermediate transfer belt 51, is set to 100 mm/sec. The intermediate transfer belt 51 can be made of a dielectric resin such as PC (polycarbonate), PET (polyethylene terephthalate), or PVDF (polyvinylidene fluoride). In the embodiment, as a intermediate transfer belt 51, a belt made of a PI (polyimide) resin in which a surface resistivity is equal to $10^{12}\Omega/\square$ (a probe which conforms with the JIS-K6911 law is used; an applied voltage is 100V, an applying time is 60 sec, 23□/50% RH) and a thickness is equal to 100 μm is used. The intermediate transfer belt 51 is not limited to such a material but another belt made of a material, volume resistivity, and thickness may be used.

The primary transfer roller 53 is made of the core 531 having an outer diameter of 8 mm and the conductive urethane sponge layer 532 having a thickness of 4 mm. An electric resistance value of the primary transfer roller 53 is equal to about $10^5\Omega$ (23□/50% RH). The electric resistance value of the primary transfer roller 53 has been obtained from a current value measured by a method whereby the primary transfer roller 53 which has come into contact with a metal roller connected to the ground is rotated at a peripheral speed of 50 mm/sec under a load of 500 g weight and a voltage of 100 V is applied to the core 531.

The secondary transfer inner roller 56 is constructed by a core 561 having an outer diameter of 18 mm and a solid layer 562 made of conductive silicon rubber and having a thickness of 2 mm. An electric resistance value of the secondary transfer inner roller 56 is equal to about $10^4\Omega$ when it is measured in a manner similar to that in the case of the primary transfer roller 53.

The secondary transfer outer roller 57 is constructed by a core 571 having an outer diameter of 20 mm and a sponge layer 572 made of conductive EPDM rubber and having a thickness of 4 mm. An electric resistance value of the secondary transfer outer roller 57 is equal to about $10^8\Omega$ when it is measured in a manner similar to that in the case of the primary transfer roller 53. An applied voltage upon measurement is set to 2000 V.

First Embodiment

Figure 3:
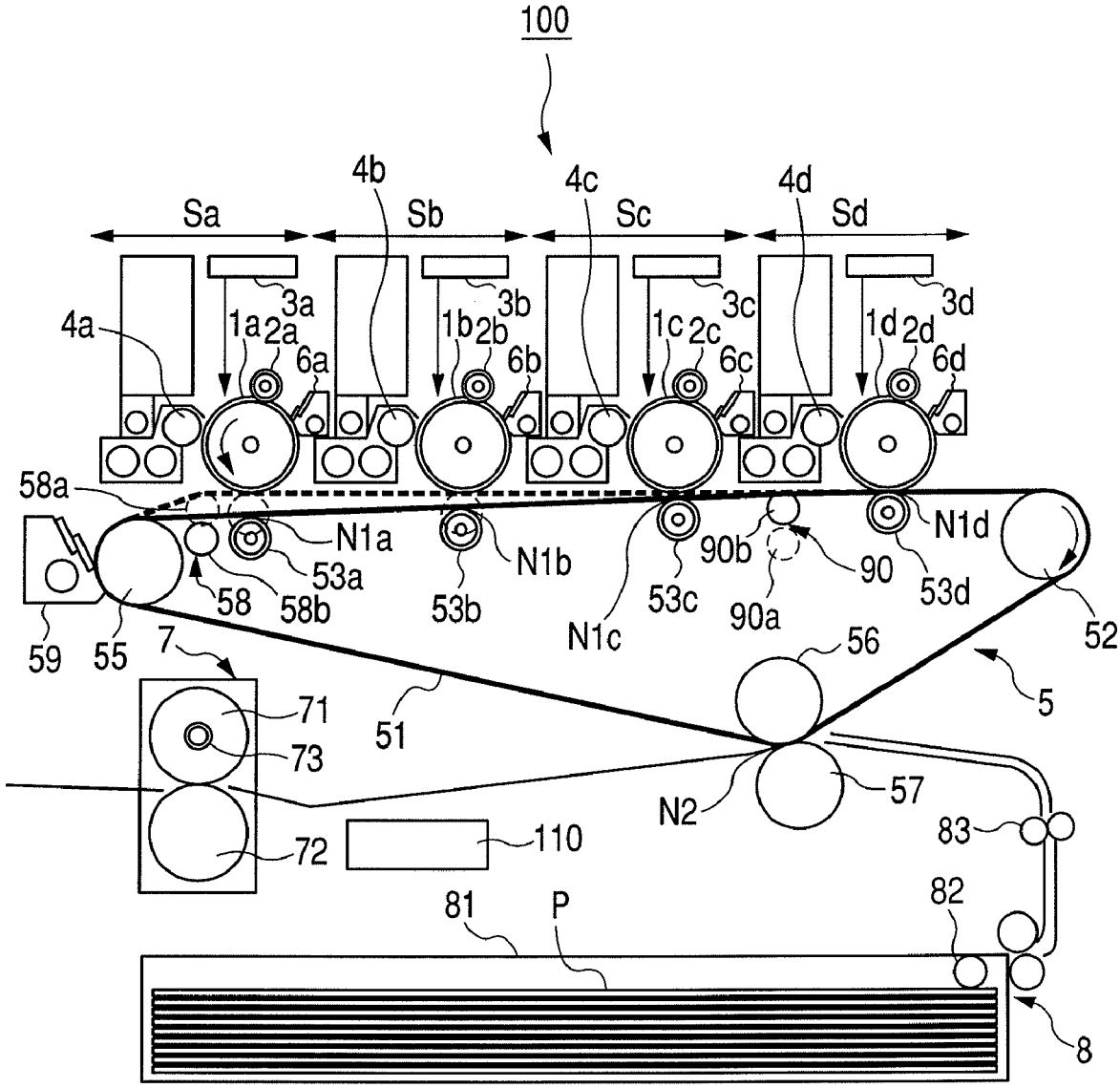
FIG. 3 is an explanatory diagram of a state where an intermediate transfer belt is separated from photosensitive drums.
Figure 4:
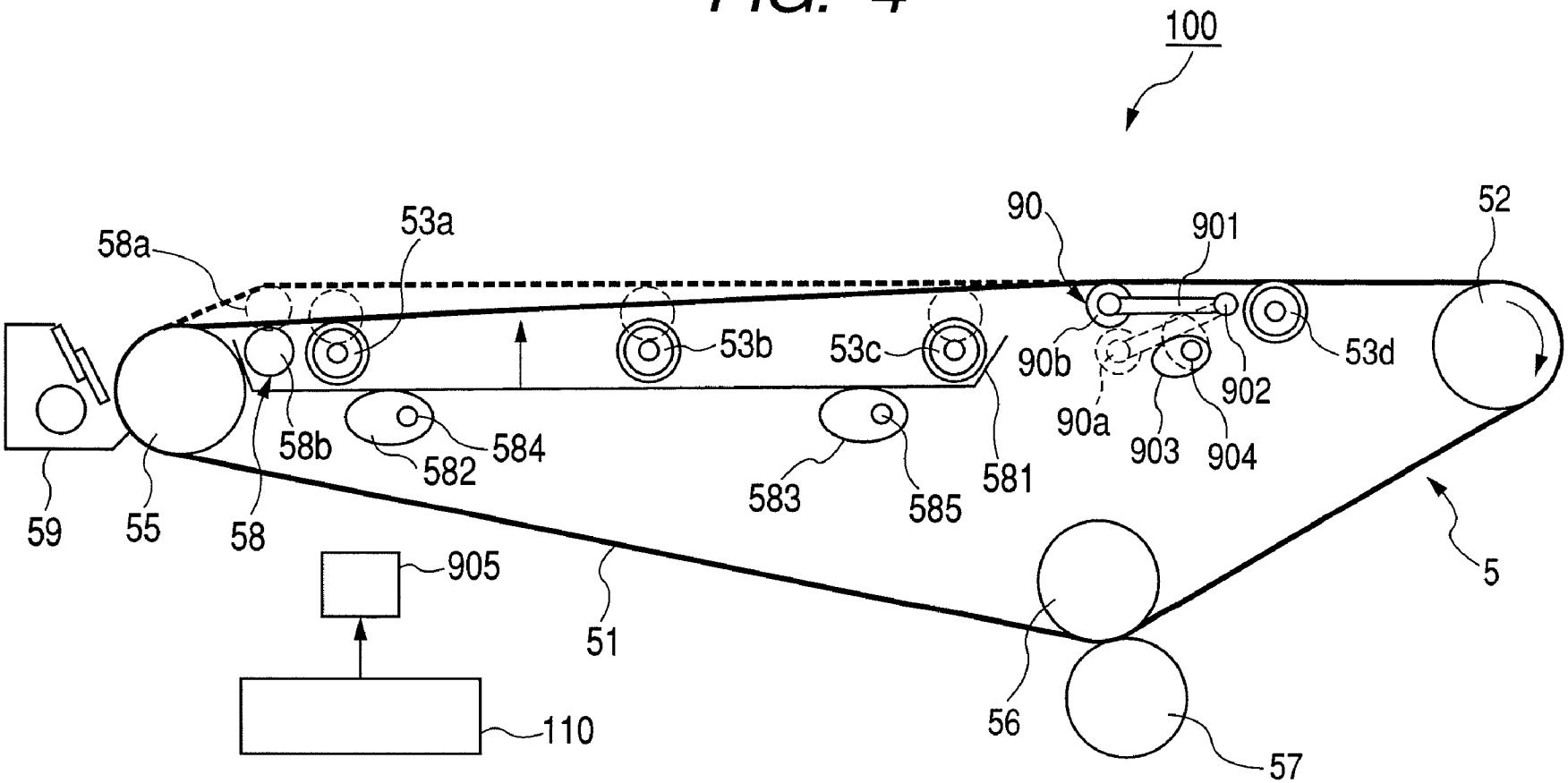
FIG. 4 is an explanatory diagram of the intermediate transfer belt and an attaching/detaching mechanism of a supporting roller.
Figure 5:
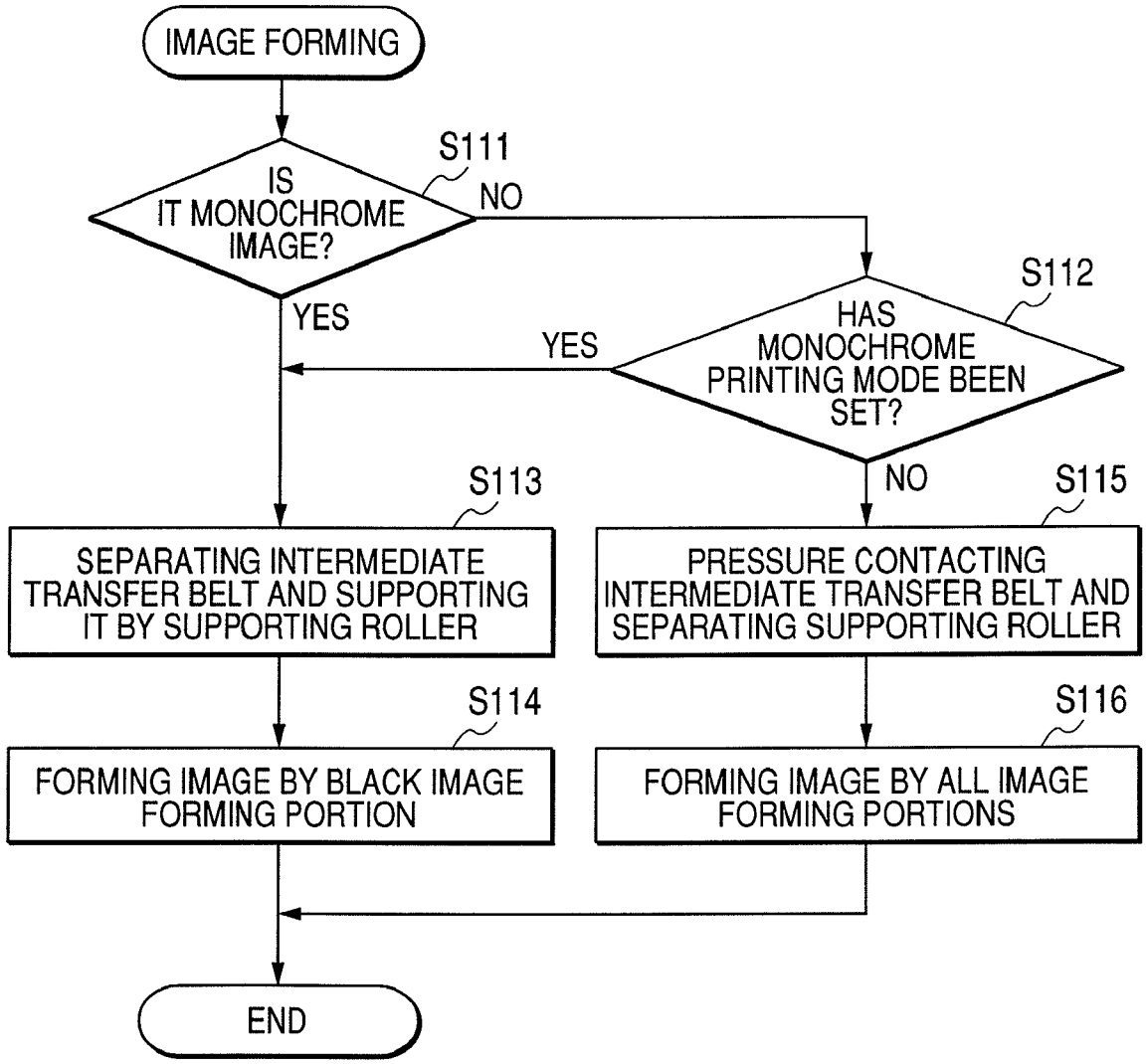
FIG. 5 is a flowchart for ascending/descending control of the supporting roller.

FIG. 3 is an explanatory diagram of a state where the intermediate transfer belt is separated from the photosensitive drums. FIG. 4 is an explanatory diagram of the intermediate transfer belt and an attaching/detaching mechanism of the supporting roller. FIG. 5 is a flowchart for ascending/descending control of the supporting roller. In the first embodiment, when a monochrome image is formed by the image forming apparatus 100, the intermediate transfer belt 51 is separated from the photosensitive drums 1*a*, 1*b*, and 1*c* and an inside surface (inner peripheral surface) of the intermediate transfer belt 51 is supported by a regulating roller (supporting member) 90. When a color image is formed, the regulating roller 90 is separated from the inside surface of the intermediate transfer belt 51, thereby preventing the regulating roller 90 from exerting an influence on the charging state of the intermediate transfer belt 51.

As illustrated in FIG. 1, the image forming apparatus 100 has the upstream regulating roller 58 upstream of the photosensitive drum 1*a* and the regulating roller 90 upstream of the photosensitive drum 1*d*.

As illustrated in FIG. 3, the upstream regulating roller (belt contacting and separating unit) 58 moves between an ascending position 58*a* and a descending position 58*b* and ascends/descends the intermediate transfer belt 51, thereby controlling the pressure contact/separation between the photosensitive drums 1*a*, 1*b*, and 1*c* and the intermediate transfer belt 51. The upstream regulating roller 58 supports the inside surface of the intermediate transfer belt 51 at the ascending position 58*a*, forms a straight line portion of the intermediate transfer belt 51 between the upstream regulating roller 58 and the driving roller 52, thereby assuring the contacting state and contacting position between the photosensitive drum 1*a* and the intermediate transfer belt 51 to be constant.

When the intermediate transfer belt 51 descends and is separated from the photosensitive drums 1*a*, 1*b*, and 1*c*, the regulating roller 90 supports the inside surface of the intermediate transfer belt 51 at an ascending position 90*b*, thereby assuring the contacting state and contacting position between the photosensitive drum 1*d* and the intermediate transfer belt 51 to be constant.

When the photosensitive drums 1*a*, 1*b*, and 1*c* come into contact with and are separated from the intermediate transfer belt 51, the regulating roller 90 regulates changes in the contacting state and contacting position between the photosensitive drum 1*d* and the intermediate transfer belt 51.

When the intermediate transfer belt 51 comes into pressure contact with the photosensitive drums 1*a*, 1*b*, and 1*c*, the regulating roller 90 is moved to a descending position 90*a* and is separated from the intermediate transfer belt 51.

As illustrated in FIG. 4, rotary axes of the upstream regulating roller 58 and the primary transfer rollers 53*a*, 53*b*, and 53*c* are fixed to a common retract frame 581. The upstream regulating roller 58 is connected to the grounding potential. The primary transfer rollers 53*a*, 53*b*, and 53*c* are insulated from the retract frame 581 and independent primary transfer bias voltages can be applied to them, respectively.

The retract frame 581 moves vertically while maintaining parallelism by rotating in parallel a cam (supporting member contacting and separating unit) 582 which rotates around a rotary axis 584 and a cam 583 which rotates around a rotary axis 585. A looseness of the intermediate transfer belt 51 which is caused in association with the ascending/descending of the retract frame 581 is absorbed by the movement of the tension roller 55. Since the position of the belt cleaning apparatus 59 is fixed to the tension roller 55, even if the tension roller 55 moves, the positional relation between the belt cleaning apparatus 59 and the intermediate transfer belt 51 is held constant.

The regulating roller 90 is axially supported to a front edge of an arm 901 which is rotatable around a rotary axis 902 and is connected to the grounding potential. By rotating a cam (supporting member contacting and separating unit) 903 which is rotatable around a rotary axis 904, the arm 901 is rotated, thereby ascending or descending the regulating roller 90.

The rotary axes 584, 585, and 904 are rotated in parallel by an interlocking mechanism (not shown) which is driven by a motor (driving source) 905. In the step of rotating the rotary axes 584 and 585 clockwise in the diagram and stopping the upstream regulating roller 58 at the ascending position 58*a*, the interlocking mechanism rotates the rotary axis 904 in the opposite direction, thereby stopping the regulating roller 90 at the descending position 90*a*. In the step of rotating the rotary axes 584 and 585 counterclockwise in the diagram and stopping the upstream regulating roller 58 at the descending position 58*b*, the interlocking mechanism rotates the rotary axis 904 in the opposite direction, thereby stopping the regulating roller 90 at the ascending position 90*b*.

With reference to FIGS. 1 to 4, when the image forming is instructed as shown in FIG. 5, a control unit 110 discriminates whether or not the image data indicates a monochrome image (step S111). If the image data does not indicate the monochrome image (NO in S111), whether or not a monochrome printing mode has been set is discriminated (S112).

In the case of the monochrome image (YES in S111) or in the case of the monochrome printing mode (YES in S112), the control unit 110 forms the image in a black monochromatic mode. The motor 905 is made operative, the upstream regulating roller 58 is positioned to the descending position 58*b*, the regulating roller 90 is positioned to the ascending position 90*b*, and the intermediate transfer belt 51 is separated from the photosensitive drums 1*a*, 1*b*, and 1*c* (S113).

Thus, the photosensitive drums 1*a*, 1*b*, and 1*c* are not driven-rotated by the intermediate transfer belt 51 and the intermediate transfer belt 51 is bent and supported by the regulating roller 90 (S113). The primary transfer portion N1*d* of the photosensitive drum 1*d* is reconstructed at the same position as that in the case where the intermediate transfer belt 51 is not separated from the drums. The control unit 110 makes operative only the image forming portion Sd for forming the black toner image, thereby forming the image (S114).

In the case of forming a color image (NO in S112), the control unit 110 forms the image in a full-color mode. The motor 905 is made operative, the upstream regulating roller 58 is positioned to the ascending position 58*a*, the regulating roller 90 is positioned to the descending position 90*a* (S115), and the intermediate transfer belt 51 comes into pressure contact with the photosensitive drums 1*a*, 1*b*, and 1*c* (S115). Thus, the photosensitive drums 1*a*, 1*b*, and 1*c* are driven-rotated by the intermediate transfer belt 51 and the regulating roller 90 does not come into contact with the intermediate transfer belt 51 (S115). The primary transfer portions N1*a*, N1*b*, N1*c*, and N1*d* are uniformly arranged. The control unit 110 makes the image forming portions Sa, Sb, Sc, and Sd operative, thereby forming the toner images of the separating colors of yellow, magenta, cyan, and black (S116).

The image forming apparatus 100 has a full-color mode (first image forming mode) and a black monochromatic mode (second image forming mode). According to those modes, the image forming apparatus 100 allows the intermediate transfer belt 51 to come into contact with and be separated from the photosensitive drums 1*a*, 1*b*, and 1*c*. The regulating roller 90 for supporting the inside surface of the intermediate transfer belt 51 is provided lest a tension angle at the transfer surface of the intermediate transfer belt 51 becomes unstable in association with the contact/separation operations. The regulating roller 90 comes into contact with and is separated from the intermediate transfer belt 51 as necessary.

As illustrated in FIG. 1, when the image forming apparatus 100 forms the image in the full-color mode, the intermediate transfer belt 51 comes into pressure contact with the photosensitive drums 1*a* to 1*d* and uniformly forms the primary transfer portions N1*a* to N1*d*. At this time, the upstream regulating roller 58 moves to the ascending position 58*a* and regulates the position of the intermediate transfer belt 51. The surface of the intermediate transfer belt 51 suspended between the upstream regulating roller 58 and the driving roller 52 constructs a straight line portion. The regulating roller 90 has been shunted to the descending position 90*a* separated from the intermediate transfer belt 51 in order to avoid its influence on the toner image formed on the intermediate transfer belt 51.

As illustrated in FIG. 3, when the image forming apparatus 100 forms the image in the black monochromatic mode, the intermediate transfer belt 51 is separated from the photosensitive drums 1*a*, 1*b*, and 1*c* (first image bearing member). The intermediate transfer belt 51 comes into pressure contact with only the photosensitive drum 1*d* (second image bearing member) and forms only the primary transfer portion N1*d*. The black monochrome image is transferred onto the intermediate transfer belt 51. At this time, the upstream regulating roller 58 moves to the descending position 58*b* and regulates the position of the intermediate transfer belt 51.

In order to stably form the transfer nip of the primary transfer portion N1*d* in the black monochromatic mode, the regulating roller 90 for regulating the inside surface of the intermediate transfer belt 51 is arranged on the upstream of the primary transfer roller 53*d*. The regulating roller 90 has been shunted to the descending position 90*a* in the full-color mode. However, in the black monochromatic mode, the regulating roller 90 is moved to the ascending position 90*b* and supports the intermediate transfer belt 51 so as to bend it.

The regulating roller 90 is shunted in the full-color mode and comes into contact with the inner surface of the intermediate transfer belt 51 in the black monochromatic mode. Thus, toner scattering of the line image and the lateral striped flutter in the halftone image in the full-color mode are avoided. The primary transfer of the black toner image in the black monochromatic mode can be also stably performed.

In the black monochromatic mode, it is also possible to set the descending position 58*b* to a position lower than the tension roller 55, thereby separating the upstream regulating roller 58 from the intermediate transfer belt 51. The position of the intermediate transfer belt 51 is regulated by the tension roller 55 and the regulating roller 90 and the driven load of the upstream regulating roller 58 can be eliminated.

Each of the regulating roller 90 and the upstream regulating roller 58 is made by a hollow aluminum pipe having an outer diameter of 16 mm and is connected to the grounding potential. The rollers 90 and 58 are not limited to those outer diameters and material but a semiconductive rubber roller or the like can be also used.

It is desirable that the regulating roller 90 is positioned near the primary transfer portion N1*d* so that the primary transfer portion N1*d* in the black monochromatic mode is stabilized. To avoid an interference and a discharge leakage which are caused when the primary transfer bias voltage has been applied to each of the primary transfer rollers 53*c* and 53*d*, it is desirable to have a surface distance of the regulating roller 90 from each of the primary transfer rollers 53*c* and 53*d* be 5 mm or more. In the first embodiment, an interval between the primary transfer portions N1*c* and N1*d* is set to 80 mm and the regulating roller 90 is arranged on the upstream side from the primary transfer portion N1*d* by 40 mm. That is, the regulating roller 90 is positioned at an intermediate point of the primary transfer portions N1*c* and N1*d*.

To prevent a discharge and a short-circuit from occurring between the regulating roller 90 at the grounding potential and the intermediate transfer belt 51, as an interval between the regulating roller 90 and the intermediate transfer belt 51 when the regulating roller 90 is separated from the intermediate transfer belt 51, an interval of 5 mm or more is assured.

In order to enable the regulating roller 90 to stably regulate the intermediate transfer belt 51 in the black monochromatic mode, it is desirable to set a contact angle of the intermediate transfer belt 51 to be equal to 30 or more. If the contact angle is set to be too large, a stroke of the attaching/detaching operation of the regulating roller 90 becomes too large and there is a risk of an increase in size of the mechanism. Therefore, it is desirable to set an upper limit of the contact angle to be about 30°.

Since the driving roller 52 has been connected to the grounding potential, when the intermediate transfer belt 51 comes into contact with the driving roller 52 on the downstream of the primary transfer portion N1*d*, the charging state of the intermediate transfer belt 51 by the primary transfer roller 53*d* changes. Thus, there is a possibility of the disturbance of the toner image which has primarily been transferred by the primary transfer portion N1*d*. Since the operation to separate the driving roller 52 from the intermediate transfer belt 51 like a regulating roller 90 is impossible, it is desirable that the driving roller 52 is separated from the primary transfer portion N1*d* as far as possible. In the embodiment, it has been confirmed that by separating the primary transfer roller 53*d* from the driving roller 52 at a distance of 80 mm, the disturbance of the toner image in the driving roller 52 can be avoided.

According to such an observed result, even in the state where the regulating roller 90 is in pressure contact with the intermediate transfer belt 51, by separating the primary transfer roller 53*c* on the upstream from the regulating roller 90 at a distance of 80 mm, there is a possibility that the disturbance of the toner image can be avoided. However, it is necessary to uniformly form the image forming portions Sa, Sb, Sc, and Sd as units and to uniformly set the intervals among the primary transfer rollers 53*a*, 53*b*, 53*c*, and 53*d*. Therefore, it is difficult to increase only the interval between the primary transfer rollers 53*c* and 53*d* where the regulating roller 90 is arranged. If the intervals among the primary transfer rollers 53*a*, 53*b*, 53*c*, and 53*d* are uniformly set to a large value, the intermediate transfer unit 5 also increases in size and the whole size of the main body increases remarkably. Therefore, the invention using the attaching/detaching structure of the regulating roller 90 is very effective also in consideration of reduction of the main body size.

As described above, according to the first embodiment, the regulating roller 90 is shunted in the full-color mode and comes into contact with the inside surface of the intermediate transfer belt 51 in the black monochromatic mode. Therefore, toner scattering of the line image and the lateral striped flutter in the halftone image in the full-color mode are avoided. The primary transfer of the black toner image in the black monochromatic mode can be also stably performed.

Modification of the First Embodiment

In the first embodiment, the regulating roller 90 has been ascended/descended perfectly synchronously with the ascending/descending of the intermediate transfer belt 51. However, the ascending/descending of the retract frame 581 for ascending/descending the intermediate transfer belt 51 and the rotation of the arm 901 for ascending/descending the regulating roller 90 can be individually driven. Although the number of necessary motors increases, the ascending/descending of the regulating roller 90 can be controlled finer than that in the case of the first embodiment.

For example, when the printing mode is switched from the full-color mode to the black monochromatic mode, the procedure for attaching/detaching the regulating roller 90 can be controlled as follows. After the toner images which had been formed on the photosensitive drums 1*a*, 1*b*, and 1*c* and had been primarily transferred onto the intermediate transfer belt 51 passed through the regulating roller 90, the regulating roller 90 is ascended so as to come into contact with the intermediate transfer belt 51. After that, the upstream regulating roller 58 is moved downward, thereby separating the intermediate transfer belt 51 from the photosensitive drums 1*a*, 1*b*, and 1*c*.

When the printing mode is switched from the black monochromatic mode to the full-color mode, the upstream regulating roller 58 is moved upward, thereby allowing the intermediate transfer belt 51 to come into contact with the photosensitive drums 1*a*, 1*b*, and 1*c*. After that, the toner images formed on the photosensitive drums 1*a*, 1*b*, and 1*c* are transferred onto the intermediate transfer belt 51. Before those images pass through the regulating roller 90, the regulating roller 90 is separated from the intermediate transfer belt 51.

By the operating procedure as mentioned above, such a situation where the full-color image is disturbed by the regulating roller 90 in the full-color mode and the primary transfer portion N1*d* becomes unstable in the black monochromatic mode can be avoided. Further, an operating rate of the image forming apparatus can be raised by mutually switching the full-color mode and the black monochromatic mode in a short time.

Second Embodiment

Figure 6:
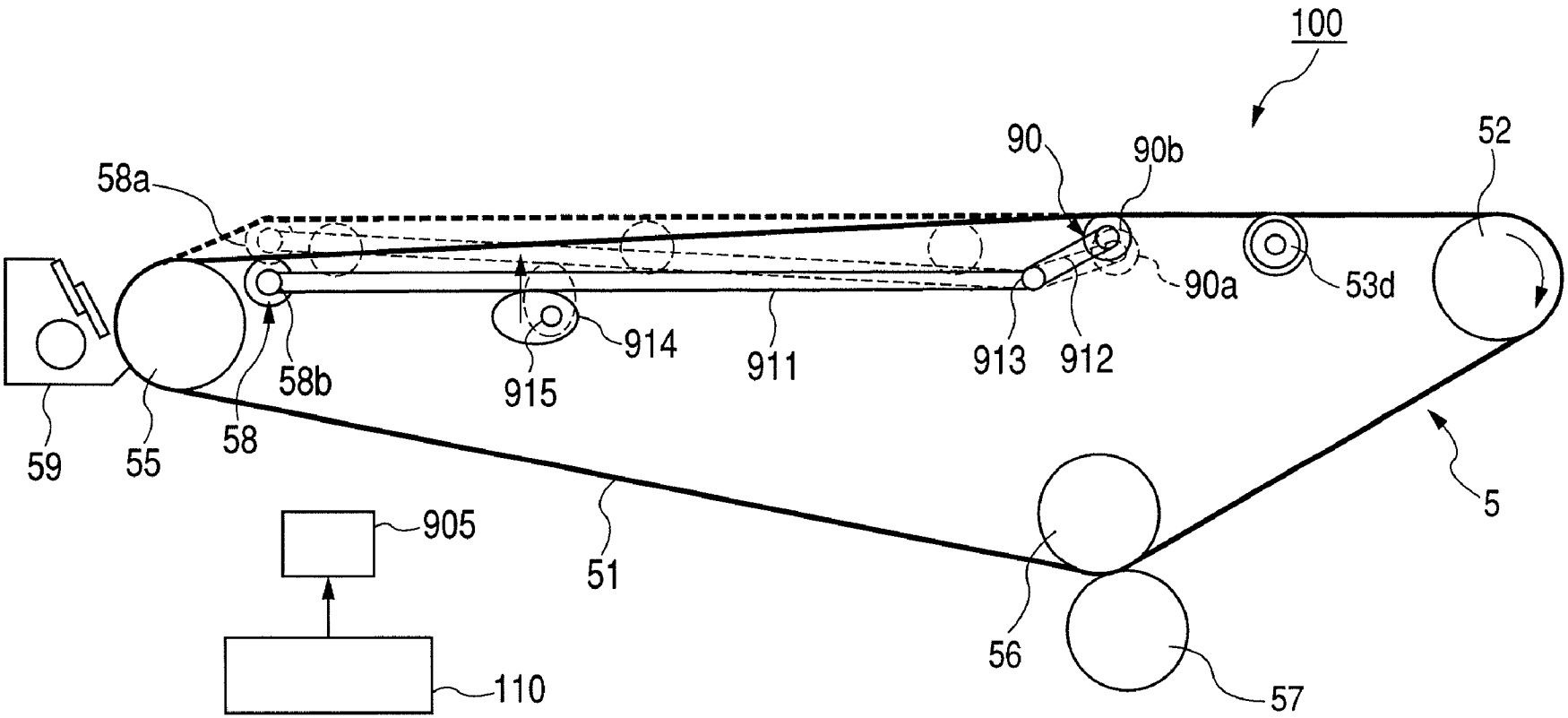
FIG. 6 is an explanatory diagram of an intermediate transfer belt and an attaching/detaching mechanism of a supporting roller in the second embodiment.

FIG. 6 is an explanatory diagram of the intermediate transfer belt and the attaching/detaching mechanism of the supporting roller in the second embodiment. The second embodiment differs from the first embodiment only with respect to the intermediate transfer belt and the attaching/detaching mechanism of the supporting roller in the image forming apparatus 100 described with reference to FIGS. 1 to 3. In FIG. 6, component elements common to those in FIGS. 1 to 3 are designated by the same reference numerals and their detailed description is omitted here.

As illustrated in FIG. 6, the upstream regulating roller 58 and the regulating roller 90 are rotatably supported to link arms 911 and 912 which are integrally rotated around a rotary axis 913. When the control unit 110 makes the motor 905 operative, a rotary axis 915 is rotated and a cam (supporting member separating unit) 914 rotates. The cam 914 rotates the link arm 912 around the rotary axis 913, thereby ascending/descending the upstream regulating roller 58 and the regulating roller 90 in an interlocking relational manner.

In the full-color mode, the control unit 110 positions the upstream regulating roller 58 to the ascending position 58*a* by the cam 914 and, at the same time, positions the regulating roller 90 to the descending position 90*a*. Thus, the intermediate transfer belt 51 uniformly comes into pressure contact with the photosensitive drums 1*a*, 1*b*, 1*c*, and 1*d*, the toner images of the separating colors can be formed, and at the same time, the regulating roller 90 is separated from the intermediate transfer belt 51.

On the contrary, in the black monochromatic mode, the control unit 110 positions the upstream regulating roller 58 to the descending position 58*b*, thereby separating the intermediate transfer belt 51 from the photosensitive drums 1*a*, 1*b*, and 1*c*. At the same time, the control unit 110 positions the regulating roller 90 to the ascending position 90*b* so as to push the inside surface of the intermediate transfer belt 51 upward, thereby enabling the image to be formed by using only the photosensitive drum 1*d*.

The attaching/detaching mechanisms of the upstream regulating roller 58 and the regulating roller 90 are not limited to the structures described in the first and second embodiments.

<Image Forming Apparatus Image of Comparison>

Figure 7:
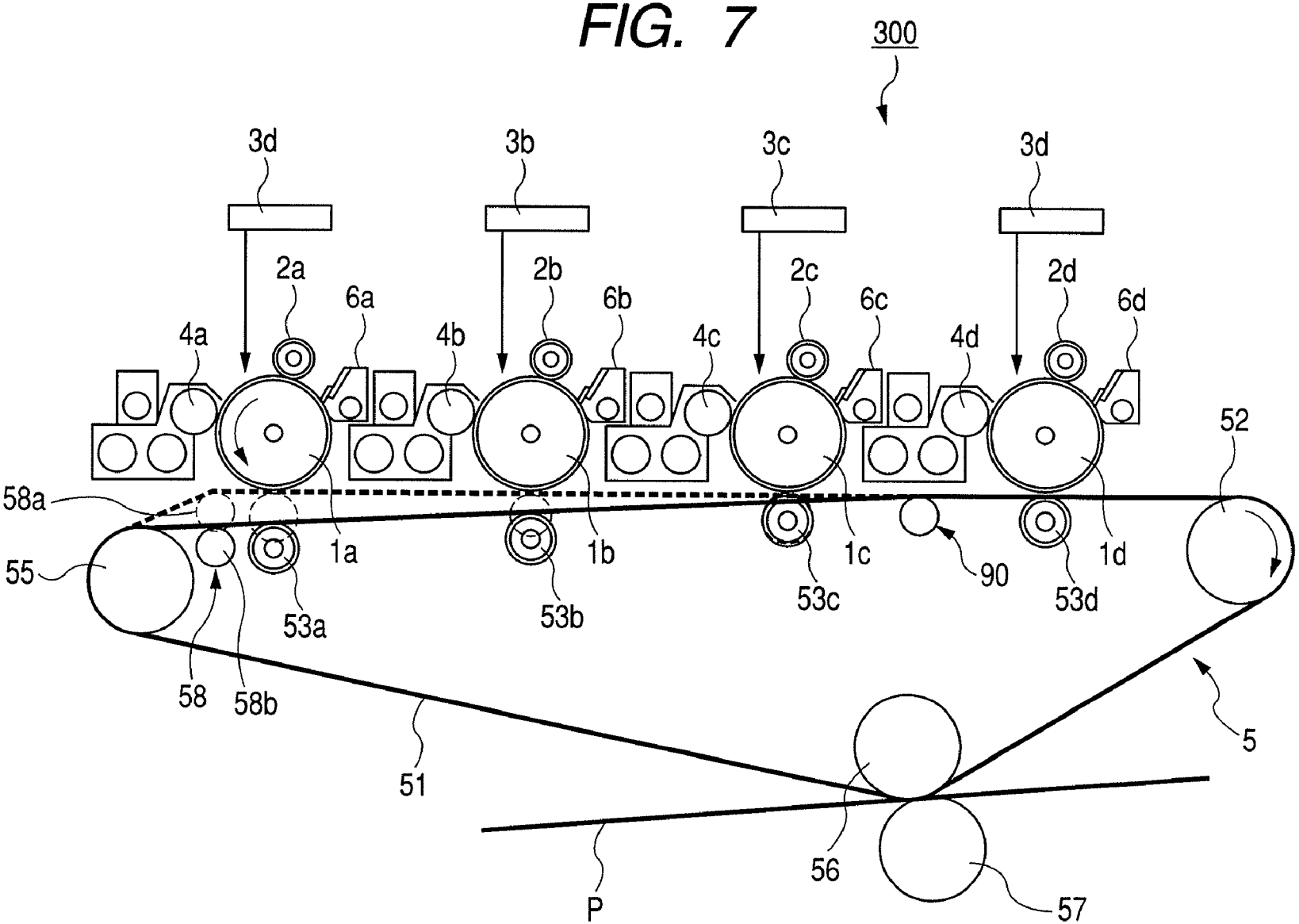
FIG. 7 is an explanatory diagram illustrating a construction of an image forming apparatus according to a comparison.
Figure 8:
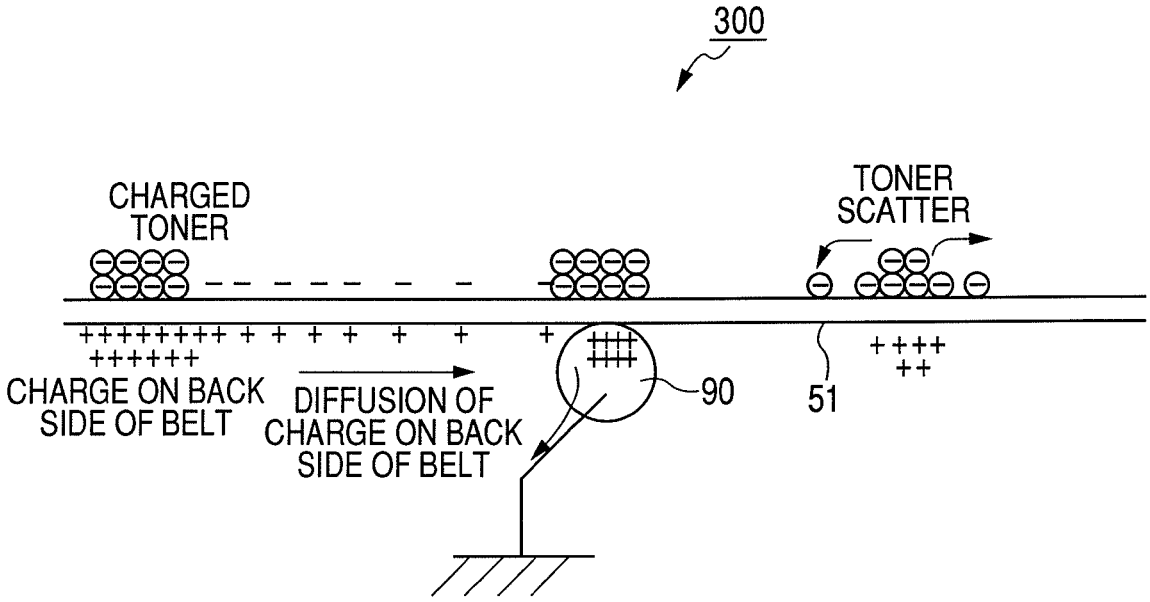
FIG. 8 is an explanatory diagram of a disturbance of a toner image on the intermediate transfer belt when the belt passes through the supporting roller.

FIG. 7 is an explanatory diagram illustrating a construction of an image forming apparatus according to a Comparison. FIG. 8 is an explanatory diagram of the disturbance of the toner image on the intermediate transfer belt when the belt passes through the supporting roller. An image forming apparatus 300 of Comparison is constructed in a manner similar to the image forming apparatus of the first embodiment except that the regulating roller 90 is always in pressure contact with the intermediate transfer belt 51. Therefore, component elements common to those in FIGS. 1 to 4 are designated by the same reference numerals and their detailed description is omitted here.

As illustrated in FIG. 7, in the image forming apparatus 300 of Comparison, the photosensitive drums 1*a*, 1*b*, 1*c*, and 1*d* are arranged at regular intervals along a straight line portion (broken line) formed by suspending the intermediate transfer belt 51 between the upstream regulating roller 58 and the driving roller 52. The regulating roller 90 is provided at an intermediate point between the photosensitive drums 1*c* and 1*d*, thereby supporting the inside surface of the intermediate transfer belt 51. By ascending/descending the upstream regulating roller 58, control can be made so that the intermediate transfer belt 51 comes into contact with and is separated from the photosensitive drums 1*a*, 1*b*, and 1*c*. In the full-color mode, as shown by the broken line, in the state where the intermediate transfer belt 51 is in pressure contact with the photosensitive drums 1*a*, 1*b*, 1*c*, and 1*d*, the toner images of the separating colors of yellow, magenta, cyan, and black are formed by the electrophotographic process. However; in the black monochromatic mode, the intermediate transfer belt 51 is separated from the photosensitive drums 1*a*, 1*b*, and 1*c* and only the black toner image is formed by the photosensitive drum 1*d*.

In the image forming apparatus 300, in the case of forming the full-color image by making the intermediate transfer belt 51 come into pressure contact with the photosensitive drums 1*a*, 1*b*, 1*c*, and 1*d*, there is a case where the toner images on the intermediate transfer belt 51 are disturbed due to the regulating roller 90. When the toner image passes through the regulating roller 90 which has been connected to the grounding potential and comes into contact with the inside surface of the intermediate transfer belt 51, toner scattering or the like of the line image on the intermediate transfer belt 51 occurs. When the toner images which have been formed by the photosensitive drums 1*a*, 1*b*, and 1*c* and have primarily been transferred onto the intermediate transfer belt 51 pass through the regulating roller 90, the toner scattering phenomenon of the line image and the lateral striped flutter in the halftone image occur.

To solve the problem in which the toner image is disturbed when the toner image formed on the intermediate transfer belt 51 passes through the driving roller 52 and the like, there is a method of applying a bias voltage to the driving roller 52 or the like. There is also a method of providing a charge removing member for the driving roller 52 or the like. However, according to the methods disclosed in Japanese Patent Application Laid-Open Nos. 2000-298408, 2006-119508, and 2004-317915 toner scattering and the lateral striped flutter which occur when the intermediate transfer belt 51 passes through the regulating roller 90 cannot be completely solved.

According to the image forming apparatus 300, since the four photosensitive drums 1*a*, 1*b*, 1*c*, and 1*d* to form the toner images of four colors exist, it is necessary to reduce the whole size of the image forming apparatus 300 by decreasing the intervals among them as much as possible. For this purpose, the regulating roller 90 is arranged near the primary transfer rollers 53*c* and 53*d*. When the bias voltage is applied to the regulating roller 90, there are such problems that designing conditions such as a creeping discharge and the like become severe and the costs for a high voltage power source and the like rise. Therefore, according to the methods disclosed in Japanese Patent Application Laid-Open Nos. 2000-298408, 2006-119508, and 2004-317915, image deterioration occurring when the intermediate transfer belt 51 passes through the regulating roller 90 cannot be avoided by the simple construction while the tension angle of the intermediate transfer belt 51 in each of the full-color mode and the black monochromatic mode is held constant.

FIG. 8 illustrates a state of toner scattering near the regulating roller 90 in FIG. 7. It is considered that the toner scattering phenomenon occurs by the following reasons.

The toner image formed on the surface of the intermediate transfer belt 51 forms a pair together with charges on the back side of the intermediate transfer belt 51, is adsorbed to the intermediate transfer belt 51, and is conveyed in the direction shown by an arrow. Surplus charges have been charged on the back side of the intermediate transfer belt 51 also including the portions where there are no toner images by the primary transfer bias voltage applied by the primary transfer roller (53*c* in FIG. 7). The surplus charges induce charges of a polarity opposite to a polarity of the primary transfer bias voltage on the surface of the intermediate transfer belt 51, thereby preventing that toner particles which have been charged to the same polarity are electrostatically scattered from the area of the toner image.

If the intermediate transfer belt 51 comes into contact with the regulating roller 90 connected to the grounding potential and the surplus charges are discharged, the charges induced on the surface of the intermediate transfer belt 51 are also extinguished and a power for preventing scattering of the toner particles is lost. The toner particles which have been charged to the same polarity and trapped to the area of the fine toner image are scattered to a region around the toner image by the mutual electrostatic repulsion. If the contacting state of the intermediate transfer belt 51 and the regulating roller 90 fluctuates and a discharge unevenness of the surplus charges occurs, a scattering pattern of the toner image according to the discharge unevenness is formed.

An influence of the regulating roller 90 which is exercised on the discharge of the surplus charges on the back side of the intermediate transfer belt 51 cannot be perfectly eliminated even if the regulating roller 90 is connected to the ground through a resistor, the bias voltage is applied, or the regulating roller 90 is not connected to the ground. It is considered that so long as the influence remains, scattering and the like of the toner particles in the toner image on the surface of the intermediate transfer belt 51 are caused by the contact of the regulating roller 90.

It can be said that scattering of the toner particles due to the regulating roller 90 is liable to occur under such a condition that the surplus charges which are charged to the intermediate transfer belt 51 are not lightened until they reach the regulating roller 90.

A time which is required until the surplus charges reach the regulating roller 90 can be expressed by L/s (sec) by using a center distance L (mm) between the primary transfer roller 53*c* and the regulating roller 90 and a processing speed s (mm/sec) of the intermediate transfer belt 51. The center distance L indicates a distance from an area where the regulating roller 90 comes into contact with the intermediate transfer belt 51 to an area where the primary transfer roller 53 which is closest in the rotating direction of the intermediate transfer belt 51 to the regulating roller 90 comes into contact with the intermediate transfer belt 51.

A characteristics time when the charges on the intermediate transfer belt 51 are attenuated until the surplus charges reach the regulating roller 90 is expressed by a function between the surface resistivity ρ (Ω/□) of the intermediate transfer belt 51 and L/s (sec). Now, a value of exp(−L/(s×log ρ)) is used as an attenuation index showing an attenuation amount of the charges given by the primary transfer roller 53*c*.

According to the image forming apparatus 100 of the first embodiment, the surface resistivity ρ of the intermediate transfer belt 51 is equal to $10^{12}$Ω/□ and the processing speed s (mm/sec) is equal to 100 mm/sec. Under such conditions, a level of toner scattering of the image at the time when the toner image passes through the regulating roller 90 is confirmed while changing the condition of the center distance L (mm) between the primary transfer roller 53 and the regulating roller 90.

TABLE 1

| Surface resistivity of belt log(ρ)[Ω/□] | Center distance L[mm] | processing speed S[mm/sec] | Attenuation index exp(−L/(s × logρ)) | Toner scatter |
|---|---|---|---|---|
| 12 | 30 | 100 | 0.975 | bad |
| 12 | 40 | 100 | 0.967 | bad |
| 12 | 50 | 100 | 0.959 | bad |
| 12 | 60 | 100 | 0.951 | bad |
| 12 | 70 | 100 | 0.943 | good |
| 12 | 80 | 100 | 0.936 | good |

As shown in Table 1, it will be understood that toner scattering cannot be permitted under the condition in which exp(−L/(s×log ρ)) as an attenuation index is equal to or larger than 0.95. Also with respect to other processing speed, belt surface resistivity, and the like, as a result of the similar confirmation, it has been found that the relaxation of the charges on the intermediate transfer belt 51 is insufficient and the toner scattering phenomenon is liable to occur under the condition of exp(−L/(s×log ρ))>0.95.

Therefore, the attaching/detaching structure of the regulating roller 90, which will be described hereinbelow, is very effective in the case of embodying under the conditions in which a layout of the regulating roller 90 and other main body constructions satisfy the above shown values.

The value of exp(−L/(s×log ρ)) as an attenuation index is less than 1 from characteristics of the function even if the center distance L between the primary transfer roller 53 and the regulating roller 90 is set to be as small as possible, the processing speed s is set to be as large as possible, and the surface resistivity ρ is set to be as large as possible. Therefore, when the attenuation index lies within a range of 0.95<exp(−L/(s×log ρ))<1, such a range is a condition in which the separating effect of the regulating roller 90 is more effective.

Third Embodiment

Figure 9:
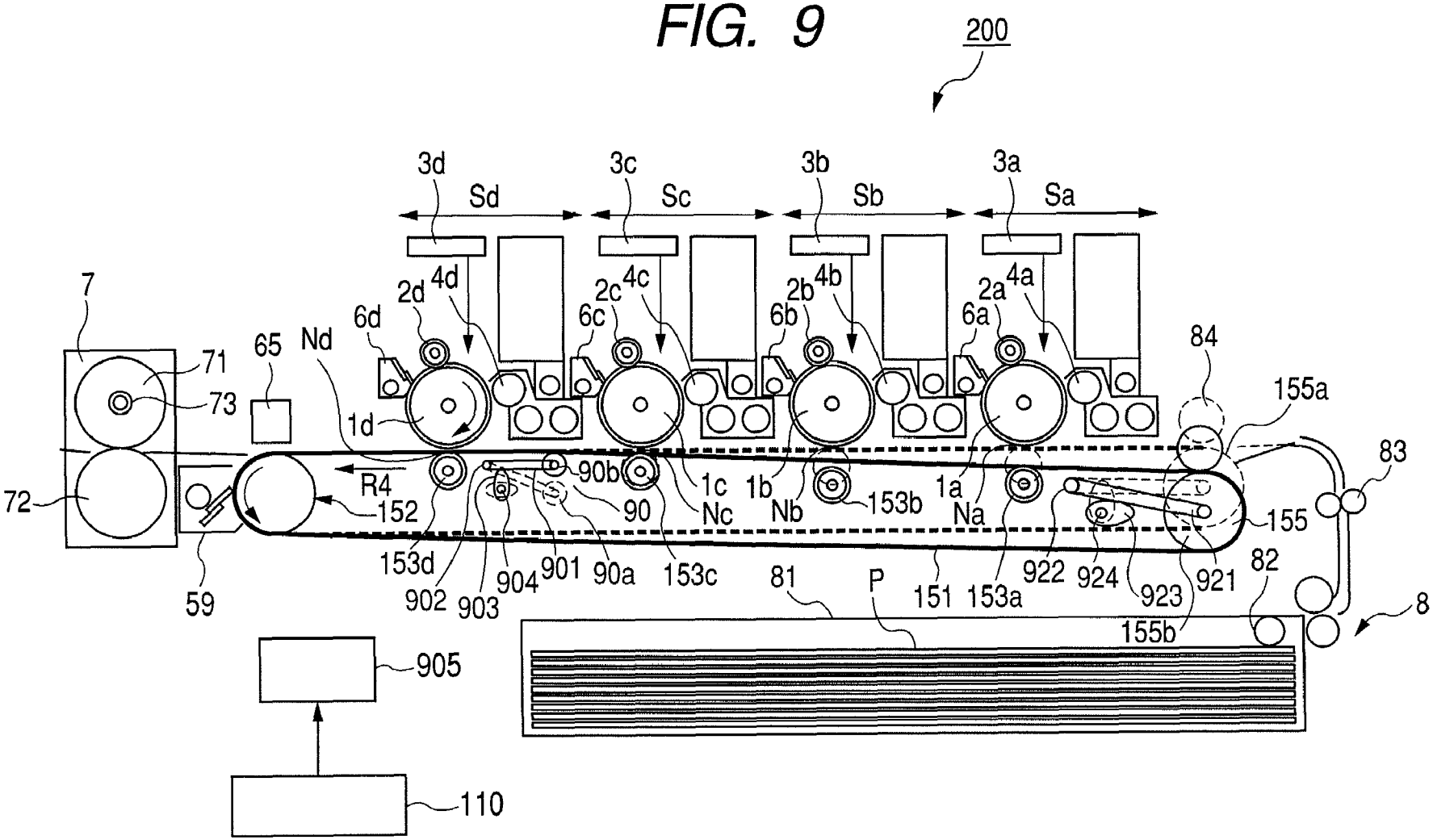
FIG. 9 is an explanatory diagram illustrating a construction of an image forming apparatus according to the third embodiment.

FIG. 9 is an explanatory diagram illustrating a construction of an image forming apparatus according to the third embodiment. An image forming apparatus 200 according to the third embodiment is a full-color electrophotographic image forming apparatus using a direct transfer system.

In the image forming apparatus 200 illustrated in FIG. 9, component elements having substantially the same functions and constructions as those in the image forming apparatus 100 illustrated in FIG. 1 are designated by the same reference numerals and their detailed description is omitted here.

In the image forming apparatus 200, the image forming portions Sa, Sb, Sc, and Sd have substantially the same construction except that the colors of the toner which are used are different. The suffixes a, b, c, and d added to the reference numerals in the diagrams in order to indicate that they are the elements provided for any one of those colors are omitted unless otherwise specified and the component elements will be collectively described.

In the image forming apparatus 200 of the third embodiment, a transfer belt 151 as a recording material conveying belt is arranged adjacent to the photosensitive drums 1*a* to 1*d* of the image forming portions Sa to Sd. The transfer belt 151 is suspended between a driving roller 152 and a tension roller 155. A driving force is transferred to the transfer belt 151 by the driving roller 152 connected to a motor mechanism (not shown), so that the transfer belt 151 is circulated in the direction of an arrow R4 in the diagram.

Transfer rollers 153*a* to 153*d* are arranged on an inside surface of the transfer belt 151 at positions which face the photosensitive drums 1*a* to 1*d*. The transfer belt 151 is urged toward the photosensitive drums 1*a* to 1*d* by the transfer rollers 153*a* to 153*d*, so that transfer portions (transfer nips) Na to Nd where the photosensitive drums 1*a* to 1*d* come into contact with the transfer belt 151 are formed.

In the image forming apparatus 200, the images formed on the photosensitive drums 1*a* to 1*d* by the image forming portions Sa to Sd are sequentially multiplexed and transferred onto the recording material P, such as paper or the like, on the transfer belt (recording material bearing belt) 151 which moves and passes adjacent to the photosensitive drums 1*a* to 1*d*.

When the images are formed, the recording materials P picked up one-by-one from the cassette 81 by the pickup roller 82 are sent to the transfer belt 151 through the registration roller 83 and the like. The recording materials P are electrostatically adsorbed onto the transfer belt 151 by a charging roller 84 and are sequentially conveyed to the transfer portions Na to Nd of the image forming portions Sa to Sd integrally with the transfer belt 151.

For example, when the full-color image is formed, the toner images of yellow, magenta, cyan, and black are formed onto the photosensitive drums 1*a* to 1*d* of the four image forming portions Sa to Sd, respectively. Transfer bias voltages are applied to the toner images of the separating colors from the transfer rollers (transfer units) 153*a* to 153*d* which face the photosensitive drums 1*a* to 1*d* through the recording material P and the transfer belt 151. The toner images are sequentially transferred onto the recording material P on the transfer belt 151.

When the transfer step in the transfer portions Na to Nd is finished, a separating bias voltage is applied to the recording material P from a separating and charge removing device 65. The recording material P is separated from the transfer belt 151 and subsequently conveyed to the fixing apparatus 7. The toner (transfer residual toner) remaining on the transfer belt 151 and the like after the transfer step are removed and collected by the belt cleaning apparatus 59.

In a manner similar to the foregoing intermediate transfer belt 51, the transfer belt 151 can be made of a dielectric resin such as PC (polycarbonate), PET (polyethylene terephthalate), or PVDF (polyvinylidene fluoride). In the third embodiment, as a transfer belt 151, a belt made of a PI (polyimide) resin in which the surface resistivity is equal to $10^{14}\Omega/\square$ (a probe which conforms with the JIS-K6911 law is used, the applied voltage is 1000V, the applying time is 60 sec, 23□/50% RH), a thickness is equal to 80 μm, and carbon has been dispersed is used. The transfer belt 151 is not limited to such a material but a belt made of another material, volume resistivity, and thickness may be used.

The transfer roller 153 has a construction similar to that of the foregoing primary transfer roller 53. The transfer roller 153 is made of a core having an outer diameter of 8 mm and the conductive urethane sponge layer having a thickness of 4 mm. An electric resistance value of the transfer roller 153 is equal to about 106.5Ω (23/50% RH). The electric resistance value of the transfer roller 153 has been obtained from the relation of a current measured by a method whereby the transfer roller 153 which has come into contact with the metal roller electrically connected to the ground is rotated at the peripheral speed of 50 mm/sec under the load of 500 g weight and the voltage of 100 V is applied to the core.

Also in the third embodiment, in a manner similar to the first embodiment, when the transfer belt 151 passes through the regulating roller (supporting member) 90, toner scattering and the like of the line image occur. Although the detailed description is omitted here because it is considered that an occurrence mechanism of such a toner scatter is similar, since the transfer belt 151 whose surface resistivity is higher than that of the intermediate transfer belt (51 in FIG. 3) is often used, a condition in which toner scattering is more liable to occur is provided.

Since toner scattering of the line image in the driving roller 152 occurs in an area where the recording material P is separated and its charges are removed by the separating and charge removing device 65, an amount of toner scattering which occurs is smaller than that of toner scattering occurring in the regulating roller 90.

The image forming apparatus 200 has the full-color mode and the black monochromatic mode. In the black monochromatic mode, the transfer belt 151 is separated from the photosensitive drums 1*a*, 1*b*, and 1*c*. In the black monochromatic mode, the inside surface of the transfer belt 151 is supported by the regulating roller 90 lest a tension angle of the transfer belt 151 in the transfer portion Nd becomes unstable in association with the separation. In the full-color mode, to prevent toner scattering of the line image in the regulating roller 90, the regulating roller 90 is shunted to the position where no influence is exerted on the charging state of the transfer belt 151.

In the full-color mode, the tension roller 155 is positioned to an ascending position 155*a* and the transfer belt 151 is suspended at a position shown by a broken line, thereby forming a straight line portion.

The tension roller 155 is axially supported to a front edge of an arm 921 which is rotatable around a rotary axis 922. By rotating a cam (belt separating unit) 923 which is rotatable around a rotary axis 924, the arm 921 is rotated, thereby ascending/descending the tension roller 155.

The transfer belt 151 comes into contact with the photosensitive drums 1*a*, 1*b*, 1*c*, and 1*d* and forms the transfer portions Na to Nd. The toner images of four colors are sequentially transferred onto the recording material P on the transfer belt 151. The regulating roller 90 is moved to the descending position 90*a* in a manner similar to the first embodiment.

In the black monochromatic mode, the tension roller 155 is positioned at a descending position 155*b*, thereby separating the transfer belt 151 from the photosensitive drums 1*a*, 1*b*, and 1*c* (first image bearing member) as illustrated by a solid line. The transfer belt 151 comes into contact only with the photosensitive drum 1*d* (second image bearing member) and forms the transfer portion Nd. Only the black toner image is transferred onto the recording material P on the transfer belt 151. In a manner similar to the first embodiment, the regulating roller 90 is moved to the ascending position 90*b* from the descending position 90*a* in the full-color mode and supports the inside surface of the transfer belt 151. Thus, the transfer belt 151 comes into contact with the photosensitive drum 1*d* and the transfer portion Nd is reconstructed in a manner similar to that in the full-color mode.

In the black monochromatic mode, since the upstream side portion of the transfer belt 151 descends together with the tension roller 155, a guiding member for guiding the recording material P to the transfer belt 151, and the charging roller 84 also descend.

In a manner similar to the first embodiment, the regulating roller 90 is shunted from the transfer belt 151 in the full-color mode and supports the inside surface of the transfer belt 151 in the black monochromatic mode. As a construction for allowing the regulating roller 90 to come into contact with and be separated from the transfer belt 151, a construction similar to that in the first embodiment is used. The regulating roller 90 is axially supported to a front edge of the arm 901 which is rotatable around the rotary axis 902 and is connected to the grounding potential. By rotating the cam (supporting member separating unit) 903 which is rotatable around the rotary axis 904, the arm 901 is rotated, thereby ascending/descending the regulating roller 90. Therefore, toner scattering of the line image and the lateral striped flutter in the halftone image in the full-color mode are avoided. The transfer of the black toner image in the black monochromatic mode can be also stably performed.

In the third embodiment, the regulating roller 90 is made by a hollow aluminum pipe having an outer diameter of 16 mm and is connected to the grounding potential. The tension roller 155 is made by an aluminum pipe having an outer diameter of 55 mm and is connected to the grounding potential. The rollers 90 and 155 are not limited to those outer diameters and material but a semiconductive rubber roller, a resin roller, or the like can be also used.

It is also possible to construct in such a manner that a charging roller (not shown) only for use in the black monochromatic mode is arranged to the side of the regulating roller 90 which faces through the transfer belt 151 and the adsorption of the recording material P in the black monochromatic mode is executed.

It is desirable that the regulating roller 90 is arranged near the transfer portion Nd so that the transfer portion Nd in the black monochromatic mode is stabilized. If the transfer portion Nd and the regulating roller 90 are too close, since a transfer current interferes between the transfer portion Nd and the regulating roller 90 through the recording material P, a predetermined distance is assured between the regulating roller 90 and the transfer roller 153*d*. Although an interval between the transfer portions Nc and Nd (interval between the photosensitive drums 1*c* and 1*d*) is equal to 100 mm, the regulating roller 90 is closer to the transfer portion Nc than the intermediate point between the transfer portions Nc and Nd and is arranged on the downstream side of 30 mm from a center of the transfer roller 153*c*.

Since the transfer bias voltage is applied to the overlapped portion of the recording material P and the transfer belt 151 and the image is transferred in the third embodiment, a transfer bias voltage that is higher than that in the first embodiment is applied to the transfer roller 153. It is desirable that the transfer roller 153*c* and the regulating roller 90 are separated at a surface distance of 10 mm or more in consideration of an influence of an inductive interference, discharge leakage, or the like.

When the regulating roller 90 is separated from the transfer belt 151, it is desirable that the regulating roller 90 and the transfer belt 151 are separated at a distance of 10 mm or more in order to avoid an influence of the discharge or the like.

In order to enable the regulating roller 90 to stably regulate the transfer belt 151 in the black monochromatic mode, it is desirable to set a contact angle of the transfer belt 151 to a large value. According to the examination of the inventors of the present invention, it is necessary to set the contact angle to 3° or more at which the transfer belt 151 can be stably regulated. On the contrary, if the contact angle is set to be too large, the sheet passage in the black monochromatic mode becomes unstable. It is, therefore, desirable to set an upper limit of the contact angle to about 10°.

With respect to the attaching/detaching mechanism of the regulating roller 90, the mechanism described in each of the first and second embodiments can be used. Another construction having the necessary response speed and stroke and the certainty of the operation may be used.

It is desirable that the procedure for attaching/detaching the regulating roller 90 satisfies the following relation. When the printing mode is switched from the full-color mode to the black monochromatic mode, after the toner images which had been formed on the photosensitive drums 1*a*, 1*b*, and 1*c* and had been transferred onto the recording material P passed through the regulating roller 90, the regulating roller 90 is made to come into contact with the transfer belt 151. After that, the tension roller 155 is moved to the descending position 155*b*, thereby separating the transfer belt 151 from the photosensitive drums 1*a*, 1*b*, and 1*c*.

When the printing mode is switched from the black monochromatic mode to the full-color mode, the tension roller 155 is moved to the ascending position 155*a*, thereby allowing the transfer belt 151 to come into contact with the photosensitive drums 1*a*, 1*b*, and 1*c*. After that, the images formed on the photosensitive drums 1*a*, 1*b*, and 1*c* are transferred onto the recording material P. Before the recording material P reaches the regulating roller 90, the regulating roller 90 is separated from the transfer belt 151.

By the operating procedure as mentioned above, such a situation that the full-color image is disturbed by the regulating roller 90 and the transfer portion Nd of the black image becomes unstable upon image forming in the black monochromatic mode can be avoided.

As described above, according to the third embodiment, also in the image forming apparatus 200 using the direct transfer system, the regulating roller 90 is shunted in the full-color mode and comes into contact with the inner surface of the transfer belt 151 in the black monochromatic mode. Thus, toner scattering of the line image and the lateral striped flutter in the halftone image in the full-color mode are avoided. The transfer of the black toner image in the black monochromatic mode can be also stably performed.

<Correspondence to the Invention>

The image forming apparatus 100 of the first embodiment has the photosensitive drums 1*c* and 1*d* and the intermediate transfer belt 51 which is moved in contact with the photosensitive drums 1*c* and 1*d* and onto which the toner image on the photosensitive drum 1*c* and the toner image on the photosensitive drum 1*d* are transferred. The image forming apparatus 100 executes the first mode (full-color mode) in which the toner images are transferred from the photosensitive drums 1*c* and 1*d* onto the intermediate transfer belt 51 and the image is formed and the second mode (black monochromatic mode) in which the toner image on the photosensitive drum 1*d* is transferred onto the intermediate transfer belt 51 and the image is formed in the state where the photosensitive drum 1*c* is separated from the intermediate transfer belt 51. The image forming apparatus 100 has the regulating roller 90 which comes into contact with the intermediate transfer belt 51 between the photosensitive drums 1*c* and 1*d* and regulates the locus of the movement of the intermediate transfer belt 51 in the second mode. The regulating roller 90 is separated from the intermediate transfer belt 51 in the first mode.

The image forming apparatus 200 of the third embodiment has the photosensitive drums 1*c* and 1*d* and the transfer belt 151 which is moved in contact with the photosensitive drums 1*c* and 1*d* through the borne recording material P and transfers the toner image on the photosensitive drum 1*c* and the toner image on the photosensitive drum 1*d* onto the recording material P. The image forming apparatus 200 executes the first mode (full-color mode) in which the toner images are transferred from the photosensitive drums 1*c* and 1*d* onto the recording material P and the second mode (black monochromatic mode) in which the toner image on the photosensitive drum 1*d* is transferred onto the recording material P in the state where the photosensitive drum 1*c* is separated from the transfer belt 151. The image forming apparatus 200 has the regulating roller 90 which comes into contact with the transfer belt 151 between the photosensitive drums 1*c* and 1*d* and regulates the locus of the movement of the transfer belt 151 in the second mode. The restricting roller 90 is separated from the transfer belt 151 in the first mode.

In the image forming apparatus 100, the photosensitive drum ic is arranged on the upstream side of the photosensitive drum 1*d* in the moving direction of the intermediate transfer belt 51. The image forming apparatus 100 has the retract frame 581 and the cams 582 and 583 for separating the intermediate transfer belt 51 from the photosensitive drum 1*c* in the state where the regulating roller 90 holds the relative positional relation between the intermediate transfer belt 51 and the photosensitive drum 1*d*.

In the second embodiment, the regulating roller 90 comes into contact with the surface of the intermediate transfer belt 51 on the side opposite to the photosensitive drum 1*d* in a mechanical interlocking relational manner with the link arm 911 and the cam 914.

In the image forming apparatus 100, a plurality of the photosensitive drums 1*a*, 1*b*, and 1*c* of the different developer colors are arranged in a line in the straight line portion of the intermediate transfer belt 51.

The image forming apparatus 100 has the control unit 110 constructed in such a manner that when the black toner image is formed and the monochrome image is formed by the photosensitive drum 1*d*, the retract frame 581 and the cams 582 and 583 are made operative, thereby separating the intermediate transfer belt 51 from the photosensitive drums 1*a*, 1*b*, and 1*c*.

The image forming apparatus 100 satisfies the relation of $0.95<\exp(-L/(s\times\log \rho))<1$ assuming that the distance from the transfer portion of the photosensitive drum ic to the regulating roller 90 is set to L (mm), the moving speed of the intermediate transfer belt 51 is set to s (mm/sec), and the surface resistivity of the intermediate transfer belt 51 is set to ρ(Ω/□).

In the image forming apparatus 100, the photosensitive drum 1*c*, the regulating roller 90, and the photosensitive drum 1*d* are arranged in order from the upstream side in the straight line interval of the intermediate transfer belt 51 which is circulated. By supporting the intermediate transfer belt 51 by the regulating roller 90 and bending the intermediate transfer belt 51, the intermediate transfer belt 51 is separated from the photosensitive drum 1*c*. The image forming apparatus 100 has the control unit 110 constructed in such a manner that in the case of rectilinearly circulating the intermediate transfer belt 51 in the straight line interval, the regulating roller 90 is shifted to the state where no influence is exerted on the charging state of the intermediate transfer belt 51.

In the image forming apparatus 100, the photosensitive drum 1*c*, the regulating roller 90, and the photosensitive drum 1*d* are arranged in order from the upstream side in the straight line interval of the intermediate transfer belt 51 which is circulated. In the state where the regulating roller 90 is in contact with the intermediate transfer belt 51, the toner image formed on the photosensitive drum 1*d* is transferred to the intermediate transfer belt 51. The image forming apparatus 100 has the control unit 110 constructed in such a manner that in the case of transferring the toner image formed on the photosensitive drum ic onto the intermediate transfer belt 51, the regulating roller 90 is shifted to the state where no influence is exerted on the charging state of the intermediate transfer belt 51.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-289269, Oct. 24, 2006, which is hereby incorporated by reference herein in its entirety.

What is claimed is:

1. An image forming apparatus comprising:

a first image bearing member which bears toner images;

a second image bearing member which bears toner images;

a rotatable intermediate transfer belt onto which the toner images are transferred from the first and second image bearing members, and the first image bearing member is disposed on an upstream side from the second image bearing member in a rotating direction of the intermediate transfer belt;

a transfer unit which transfers the toner images on the intermediate transfer belt onto a recording material;

a belt contacting and separating unit which allows the intermediate transfer belt to separate from and to come into contact with the first image bearing member;

an image forming mode executing unit which executes:

(i) a first image forming mode in which the toner images are transferred from the first and second image bearing members onto the intermediate transfer belt, in a state where the intermediate transfer belt is in contact with the first and second image bearing members and (ii) a second image forming mode in which the toner image is transferred from the second image bearing member onto the intermediate transfer belt, in a state where the intermediate transfer belt is away from the first image bearing member and is in contact with the second image bearing member;

a supporting member which is capable of supporting an inner surface of the intermediate transfer belt between the first and second image bearing members; and a supporting member contacting and separating mechanism for moving the supporting member, wherein the supporting member contacting and separating mechanism suspends the inner surface of the intermediate transfer belt on the supporting member when the second image forming mode is executed, and the supporting member contacting and separating mechanism separates the supporting member from the inner surface of the intermediate transfer belt when the first image forming mode is executed.

2. An image forming apparatus according to claim 1, further comprising a plurality of image bearing members which bear toner images, wherein a color image is formed by the toner images of a plurality of colors in the first image forming mode, and a monochrome image is formed in the second image forming mode.

3. An image forming apparatus according to claim 1, wherein the supporting member is electrically connected to ground.

4. An image forming apparatus according to claim 1, wherein when it is assumed that a distance between an area where the first image bearing member comes into contact with the intermediate transfer belt and an area where the supporting member comes into contact with the intermediate transfer belt is set to L (mm), a moving speed of the intermediate transfer belt is set to s (mm/sec), and a surface resistivity of the intermediate transfer belt is set to ρ(Ω/□), the following relation is satisfied:

$$0.95<\exp(-L/(s\times\log\rho))<1.$$

5. An image forming apparatus according to claim 1, wherein the supporting member contacting and separating mechanism includes a moving mechanism which can move the supporting member.

6. An image forming apparatus according to claim 1, further comprising a plurality of image bearing members which bears toner images, wherein the second image bearing member is on an upstream side from the transfer unit and on a primarily downstream side of the plurality of image bearing members in the rotating direction.

7. An image forming apparatus according to claim 1, wherein when the first image forming mode is switched to the second image forming mode, the first image bearing member separates from the intermediate transfer belt after the supporting member suspends the inner surface.

8. An image forming apparatus according to claim 1, when the second image forming mode is switched to the first image forming mode, the supporting member separates from the inner surface after the first image bearing member contacts with the intermediate transfer belt.

* * * * *